US006244904B1

(12) United States Patent
Fabian et al.

(10) Patent No.: US 6,244,904 B1
(45) **Date of Patent: *Jun. 12, 2001**

(54) ELECTRICAL CONNECTOR FOR ATTACHING CONDUCTORS TO SPEAKER LEADS

(75) Inventors: David James Fabian, Mount Joy; Darrell Lynn Wertz, York; Timothy Lee Kocher, Camp Hill; Randolph Lee Buchter; Robert Stewart Correll, Jr., both of Harrisburg; Dennis Leroy Kemmick, Columbia; Andrew Dewitt Balthaser, Dauphin, all of PA (US)

(73) Assignee: The Whitaker Corporation, Wilmington, DE (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/008,175

(22) Filed: Jan. 16, 1998

(51) Int. Cl.[7] ..... H01R 9/03
(52) U.S. Cl. ..... 439/656; 439/441; 439/268
(58) Field of Search ..... 439/441, 656, 439/265, 268, 188, 436, 437, 438, 439, 440, 820, 816, 259, 263, 264, 266, 330, 331, 856, 857

(56) References Cited

U.S. PATENT DOCUMENTS 2,992,401 * 7/1961 Lewis ..... 439/212
4,618,199 * 10/1986 Pfaff ..... 439/268
4,636,026 1/1987 Cooney et al. ..... 339/255 R
4,645,278 2/1987 Yevak, Jr. et al. ..... 339/17 T
4,978,315 * 12/1990 Edgley et al. ..... 439/441
5,044,973 * 9/1991 Noda et al. ..... 439/296
5,106,328 4/1992 Prochaska et al. ..... 439/751
5,324,213 * 6/1994 Frantz ..... 439/441
5,410,257 * 4/1995 Swaffield ..... 324/755
5,823,807 * 10/1998 Yamasaki et al. ..... 439/157

* cited by examiner

*Primary Examiner*—Gary F. Paumen
*Assistant Examiner*—Ross Gushi

(57) ABSTRACT

An electrical connector (16) is arranged to releasably receive a pair of conductors (22, 24) and electrically interconnecting the conductors to the terminals (30) of an acoustical speaker (14). The connector includes an insulating housing (36) and a single button (38) in sliding engagement with the housing (36). The button is slidable between a first position (42) where the conductors are held within the connector and electrically interconnected to the speaker terminals (30) and a second position (46) where the conductors (22, 24) can be inserted into the connector or removed therefrom. A pair of contact members (52, 54) are disposed in a cavity (48, 50) within the housing (36). Each contact member includes a tail (28) extending therefrom through an opening (176) in the housing and is electrically interconnected to one of the terminals via a lead (32). Each contact member has a gripping portion (68) for receiving the conductor when the button is in its second position (46) and for electrically engaging the conductor when the button is in its first position (42).

8 Claims, 6 Drawing Sheets

ELECTRICAL CONNECTOR FOR ATTACHING CONDUCTORS TO SPEAKER LEADS

The present invention relates to electrical connectors for releasably attaching conductors to leads of acoustical speakers, and more particularly to such connectors having a simplified actuating mechanism for connecting and disconnecting the conductors.

BACKGROUND OF THE INVENTION

Remote acoustical speakers used with various audio systems are typically interconnected with their audio system by means of multiple conductors. Each of the conductors is releasably received in a separate connector that is attached to a respective one of each of the speakers. These separate connectors usually include an opening through which one of the conductors is inserted and a button or lever that is depressed to move a contact within the opening to one side so that the conductor can be fully inserted. When the button or lever is released, a spring urges the movable contact across the opening so that it picks up the conductor and presses it against a fixed contact to make the desired electrical connection. Each single speaker requires two such electrical connections and, therefore, two individual connectors. Speaker hook-up wire is usually provided as integrated pairs of conductors, similar to lamp wire, the ends of each conductor must be stripped and split away from the other conductor sufficiently far to allow manipulation of the individual conductors during insertion into their respective connectors. The buttons or levers that actuate the movable contacts are bulky and usually are pivotally coupled to the connector so that they are difficult to aesthetically integrate into the speaker housing.

What is needed is a single speaker connector having contacts for receiving both speaker conductors by depressing a single actuating button and then electrically engaging and holding the two conductors upon release of the button. And the connector should lend itself to aesthetic integration into the speaker enclosure. Further, the means for returning the actuating button to its non-depressed state should be independent of the resilient members that grip and make electrical contact with the conductors, even where the conductors are of different sizes.

SUMMARY OF THE INVENTION

An electrical connector is disclosed for associating with a component for releasably receiving a conductor and electrically interconnecting the conductor to the component. The connector includes an insulating housing and an insulating button in sliding engagement with the housing. The button is slidable between a first position and a second position. A contact is disposed in a cavity within the housing and includes a tail extending therefrom through an opening in the housing and into electrical engagement with the component. The contact has a gripping portion for receiving the conductor when the button is in its second position and for electrically engaging the conductor when the button is in its first position.

An embodiment of the invention will now be described by way of example with reference to the following drawings.

DESCRIPTION OF AN EMBODIMENT OF THE INVENTION

Figure 1:
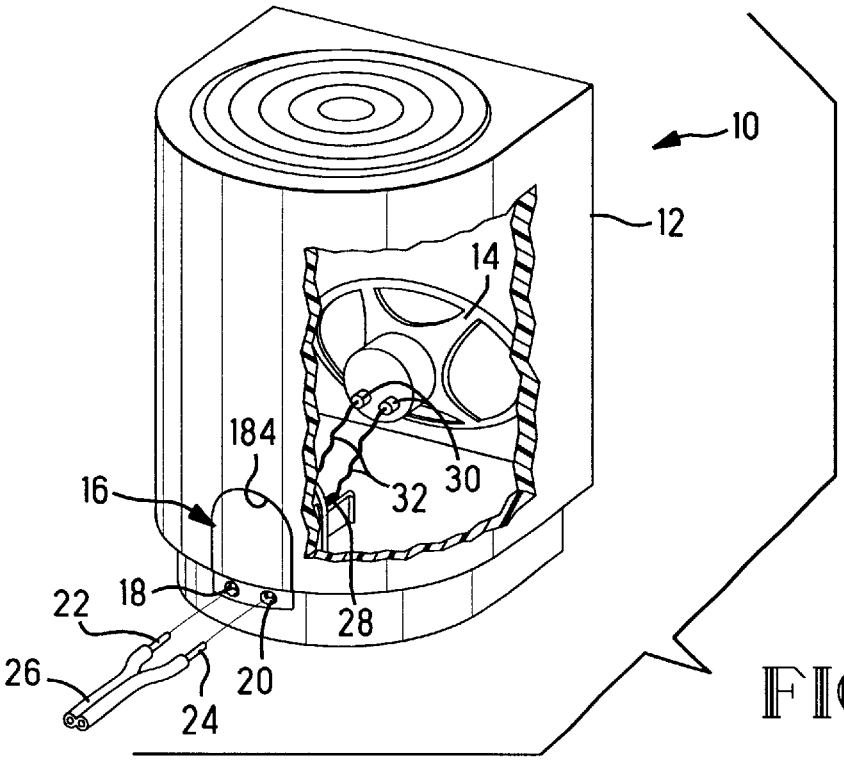
FIG. 1 is an isometric view of a speaker enclosure having a partial cutaway, incorporating the teachings of the present invention.

There is shown in FIG. 1 a speaker enclosure 10 having a curved outer housing 12 containing an acoustical speaker 14. An electrical connector 16 is arranged within an opening in the housing 12 and includes a pair of wire receiving openings 18 and 20 for receiving a pair of conductors 22 and 24 of a cable 26, one conductor in each respective opening. The connector 16 includes a pair of contact posts 28 which are interconnected to terminals 30 on the speaker 14 by means of wires 32, in the usual manner, for interconnecting each conductor 22, 24 to a respective one of the terminals 30.

Figure 6A:
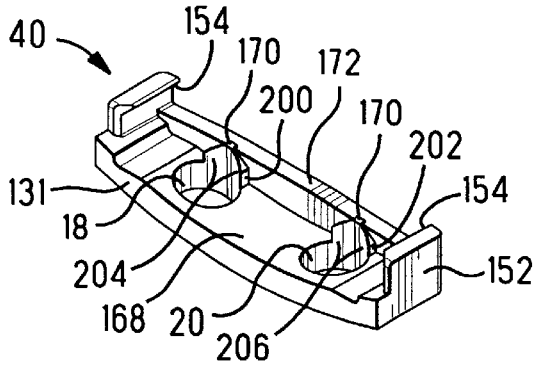
FIG. 6A is an isometric view of the bottom of the wire guide cap shown in FIG. 6.
Figure 4:
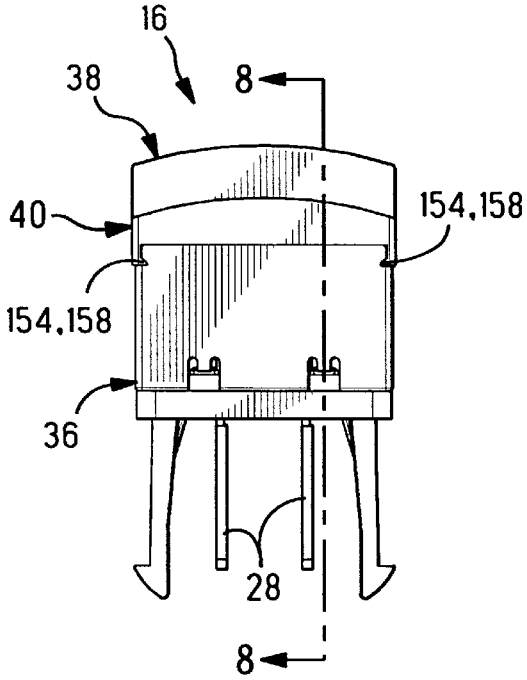
Figure 3:
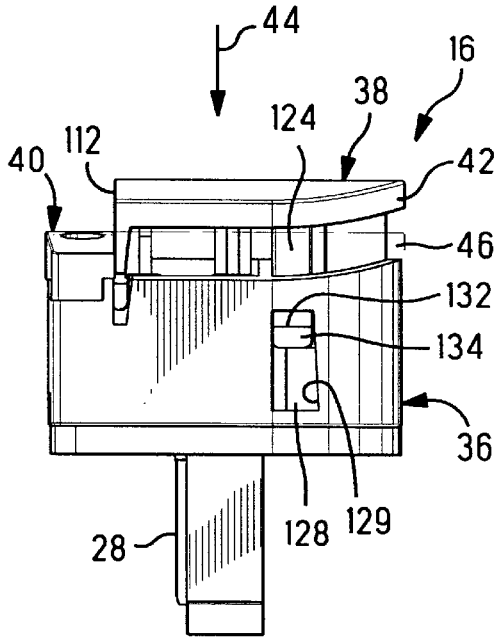
Figure 6:
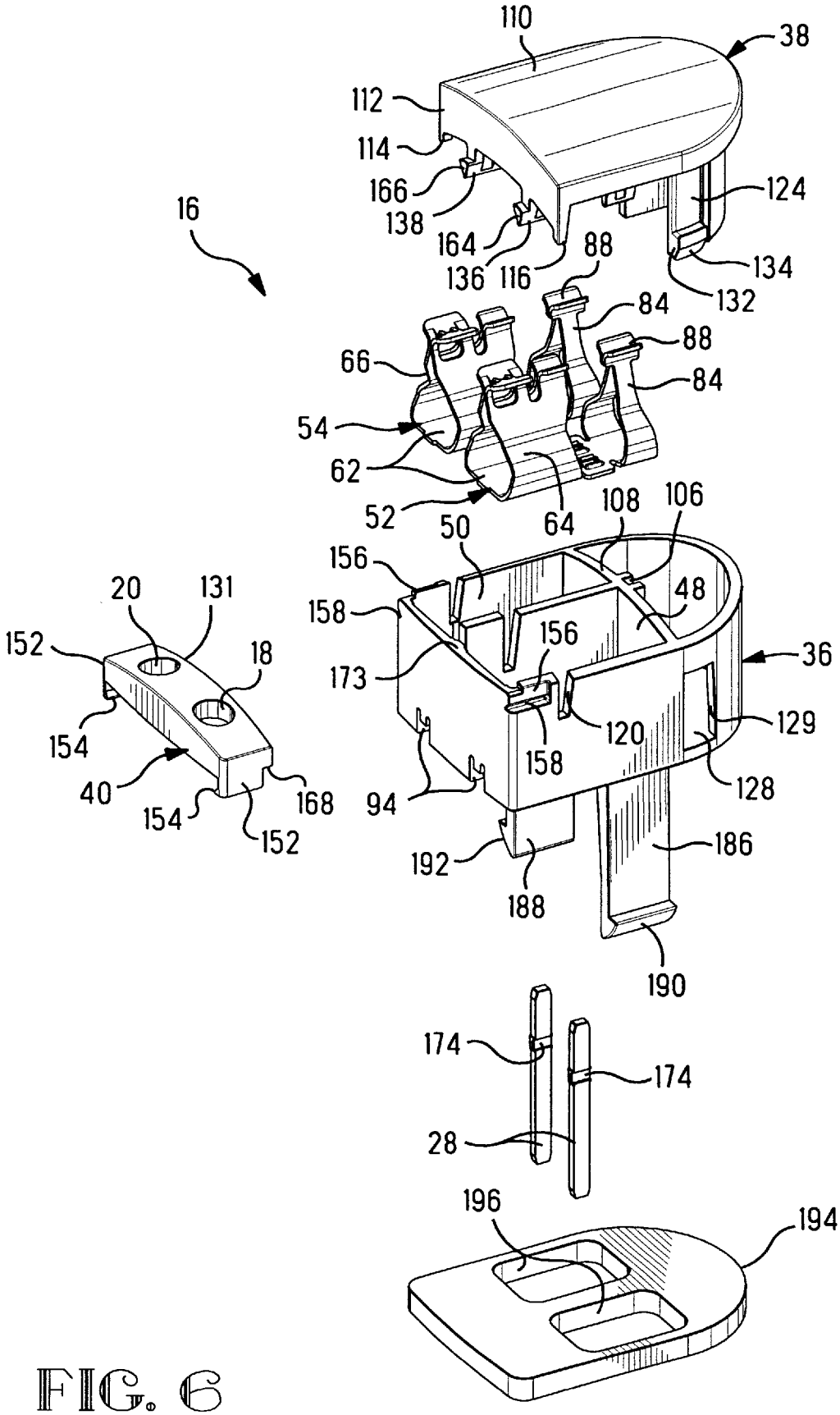
FIG. 6 is an exploded parts view of the connector shown in FIG. 2.

The connector 16, as best seen in FIGS. 2 through 7, includes an insulating housing 36, a depressable push button 38, and a wire guide cap 40. The push button 38 can be depressed from a first position 42, shown in solid lines in FIG. 3, in the direction of the arrow 44 to a second position 46 shown in phantom lines. When pressure is released, the push button is returned to its first position 42, as will be described. As best seen in FIGS. 6 and 8, the housing 36 includes two cavities 48 and 50, each of which snugly receives a respective one of first and second contact members 52 and 54 against a floor 56 of the cavities.

Figure 2:
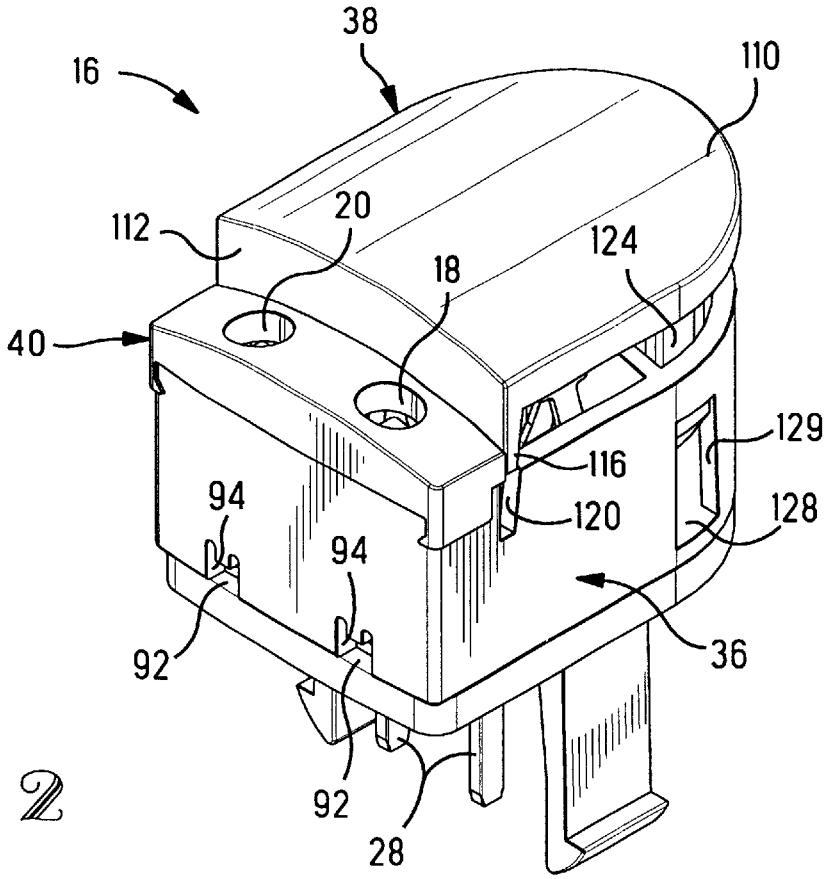
FIG. 2 is an isometric view of the connector shown in FIG. 1.
Figure 5:
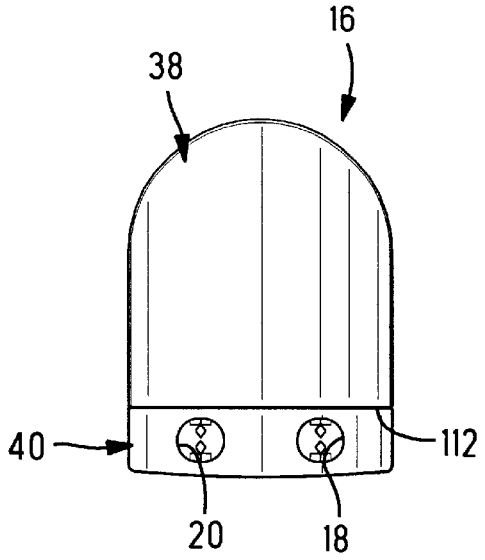
FIGS. 3, 4, and 5 are side, end, and plan views, respectively, of the connector shown in FIG. 2.
Figure 9:
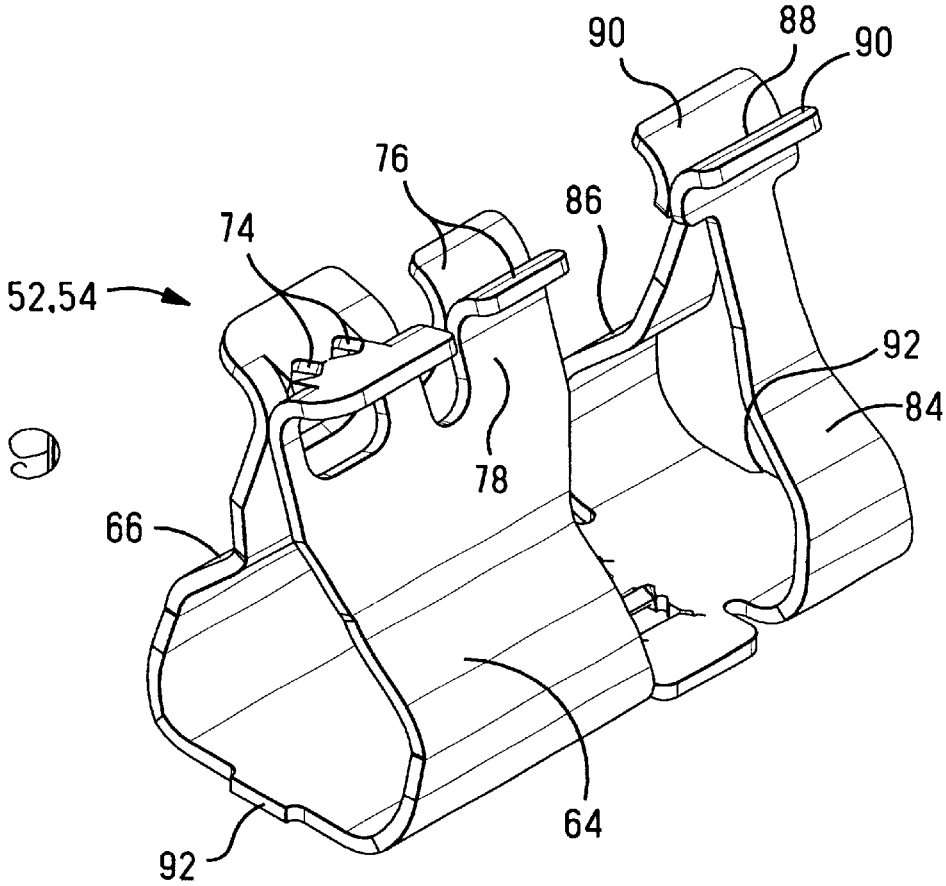
FIG. 9 is an isometric view of one of the electrical contact members shown in FIG. 6.
Figure 13:
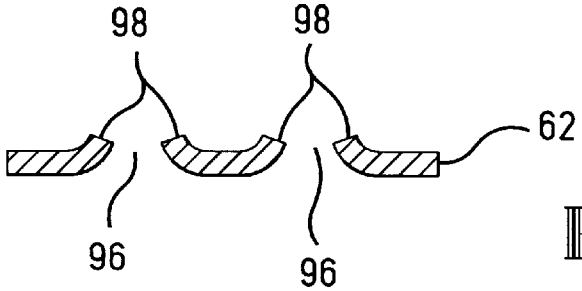
FIG. 13 is a cross-sectional view of the shank portion of the contact member taken along the lines 13—13 in FIG. 12.
Figure 12:
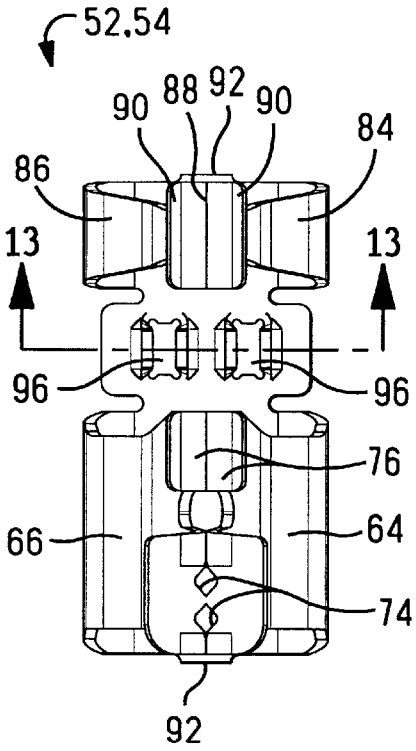
FIGS. 10, 11 and 12 are side, end, and plan views of the contact member shown in FIG. 9.
Figure 11:
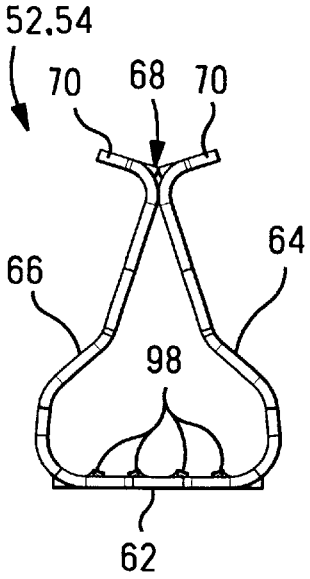
Figure 10:
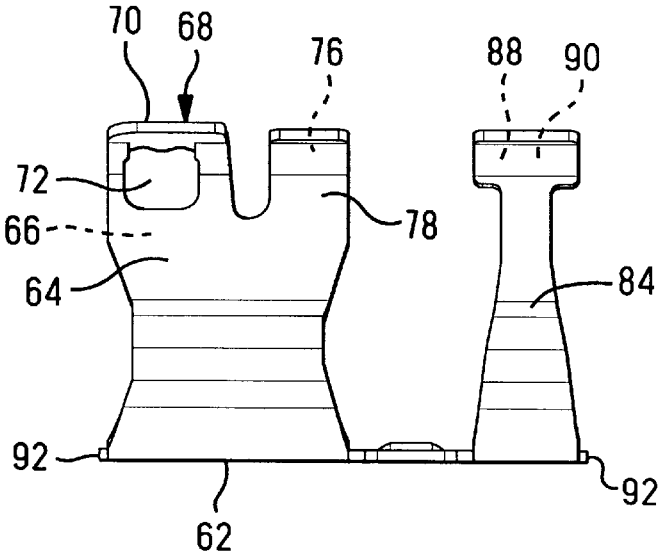

The contacts 52 and 54 are identical and will be described with reference to FIGS. 9 through 13. Each contact 52, 54 includes a shank 62 and first and second opposed beams 64 and 66, respectively, extending from opposite sides of the shank. The two beams 64 and 66 curve upwardly from the shank 62, as viewed in FIG. 11, and then mutually converge to form a gripping portion where the two beams come into pressing engagement with each other at an area of contact 68 that is spaced vertically above the shank. The two beams 64 and 66 then mutually turn outwardly to form slightly V-shaped lead in flanges 70 for guiding the conductor 22, 24 into the gripping portion when it is inserted into the connector 16. An opening 72, as best seen in FIG. 10, is formed through the first and second beams 64 and 66 so that when the flanges 70 are bent outwardly, as shown in FIG. 11, a pair of diamond-shaped openings 74 are formed in the area of contact 68 to aid in gripping the conductor 22, 24. Each of the first and second beams 64 and 66 includes a first camming surface 76 formed on an extension 78 of the respective beam. The two first camming surfaces 76 are opposed and extend mutually outwardly to form an upwardly facing V-shape, as best seen in FIG. 9, for a purpose that will be explained. The contact members 52 and 54 also include third and fourth opposed beams 84 and 86, respectively, extending from opposite sides of the shank 62 and spaced from the first and second beams 64 and 66. The two beams 84 and 86 curve upwardly from the shank 62, similarly to the beams 64 and 66 as viewed in FIG. 11, and then mutually converge into near engagement with each other at a point of proximity 88, as best shown in FIGS. 9 and 12, spaced vertically above the shank. The two beams 84 and 86 may or may not actually touch at the point of proximity. The two beams 84 and 86 then mutually turn outwardly to form a pair of second camming surfaces 90. The two second camming surfaces 90 are opposed and extend mutually outwardly to form an upwardly facing V-shape, as best seen in FIG. 9, for a purpose that will be explained. The shank 62 of each of the contacts 52 and 54 includes a short tab 92 extending from each end that interferingly engage the walls of the housing 36 as the contacts are inserted into their respective cavities 48 and 50. A pair of openings 94 are formed through one of the walls of the housing 36, as best seen in FIGS. 2 and 6, adjacent the floor 56 for receiving the tabs 92. A projection 100 extends inwardly from the housing wall adjacent the upper edge of each opening 94, as shown in FIG. 8. When the contacts are inserted fully into their respective cavity, the tab 92 of each contact snaps over the projection 100 and into its respective opening 94, thereby holding the contact in place. There are two openings 96 formed in the shank 62, as best seen in FIGS. 12 and 13. Each opening 96 includes upwardly turned edges 98 that are spaced apart so that they will provide an interference fit with the contact posts 28, as will be explained.

Figure 7:
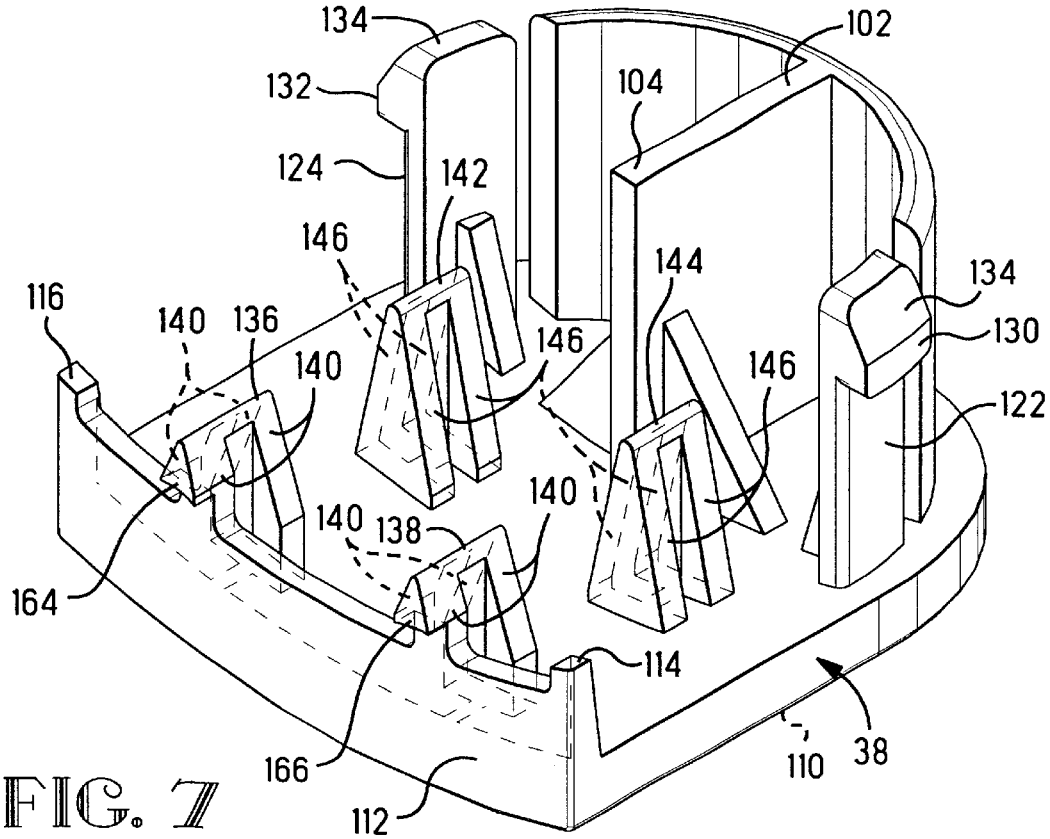
FIG. 7 is an isometric view of the push button shown in FIG. 2 taken from the bottom.
Figure 8:
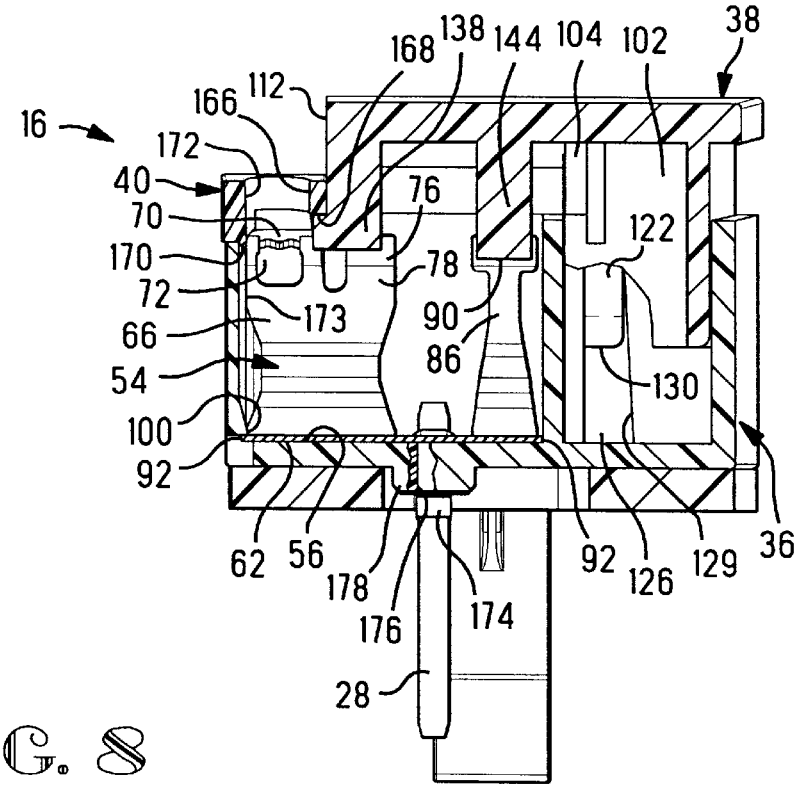
FIG. 8 is a cross-sectional view taken along the lines 8—8 in FIG. 4.

The push button 38, as best seen in FIGS. 6, 7, and 8, includes an outer surface 110 and a forward wall 112 having guide projections 114 and 116 at opposite ends that slidingly engage slots 118 and 120 formed in opposite side walls of the housing 36. The surface 110 aesthetically blends in with the outer surface of the speaker enclosure 12. A pair of somewhat resilient latch members 122 and 124 extend from the bottom side of the push button and slidingly engage respective openings 126 and 128 in opposite walls of the housing 36. The latch members 122 and 124 include projections 130 and 132 that form shoulders that engage the walls at the upper end of the openings 126 and 128 to retain the push button 38 captive to the housing 36 while allowing the push button to move vertically with respect thereto. Each latch member 122, 124 includes a camming surface 134 that engages the edges of the walls of the housing as the push button is assembled thereto, causing the latch members to elastically deflect inwardly enough to allow the projections 130 and 132 to pass along the inner wall and then snap outwardly into their respective openings 126 and 128. A support member 102 having a forward edge 104 extends upwardly from the bottom of the push button and inwardly from the back wall, as viewed in FIG. 7. The housing 36 includes a vertically disposed groove 106 in a transverse wall 108, as best seen in FIG. 6. The forward edge 104 slidingly engages the groove 106 and helps to keep the push button 36 from rocking side to side during its movement between its first and second positions. A pair of downwardly facing first wedged-shaped members, or first cams, 136 and 138 extend from the bottom side of the push button. Each of the wedge-shaped members 136 and 138 includes a pair of widely angled surfaces 140 which terminate outwardly in an apex. The member 136 is positioned vertically above a portion of the junction of the lead-in flanges 70 and the junction of the two first camming surfaces 76 of the contact 52, and the member 138 is similarly positioned with respect to the contact 54. When the push button 38 is depressed to move it from its first position 42 to its second position 46, the two first wedge-shaped members 136 and 138 engage their respective first camming surfaces 76, causing them to separate so that the first and second beams 64 and 66 of each contact elastically deflect away from each other. This causes a space to form at the area of contact 68 between the juncture of the two lead-in flanges 70 for receipt of the conductors 22 and 24. The surfaces 140 of the first wedge-shaped members are widely angled so that the space formed at the area of contact 68 is sufficient to receive 14 gage wire. This gives the connector 16 a useful range of sizes for the conductors 22 and 24 of between about 22 gage to about 14 gage. Each of the contact members 52 and 54 can accommodate any size conductor within the range independent of the size conductor in the other contact member. A pair of second wedge-shaped members, or second cams, 142 and 144 extend downwardly from the bottom of the push button 36. Each second wedge-shaped member 142, 144 is positioned vertically over the point of proximity 88 of a respective contact 52 and 54. Each of the second wedge-shaped members includes a pair of opposite angled surfaces 146 which terminate outwardly in an apex. When the push button is depressed, as described above, each of the member 142, 144 engages the two second camming surfaces 90 of its respective contact, causing the third and fourth beams 84 and 86 to elastically deflect away from each other, thereby storing energy in the beams to provide a return force. When the push button 38 is released, it is urged upwardly again to its first position 42 by means of the stored energy in the third and fourth beams, the second camming surfaces 90 pushing against the two second wedge-shaped members 142 and 144. Note that this return force is supplied by the third and fourth beams independent of the first and second beams and whether or not a conductor is present within the area of contact 68.

Figure 8A:
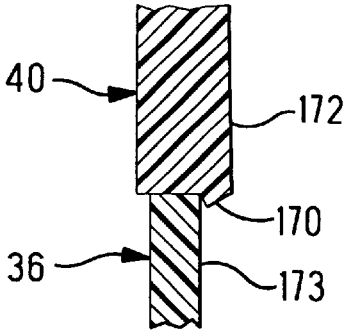
FIG. 8A is an enlarged view of a portion of that shown in FIG. 8.

The wire guide cap 40, as best seen in FIGS. 6 and 6A, includes a pair of opposite downwardly extending end walls 152 having inwardly projecting cleats 154. The end walls 152 are slidingly received in two cutouts 156 formed in opposite sides of the housing 36. The cleats 154 slidingly engage dovetail-like slots 158 formed in the sides of the housing. A pair of angled projections 170 extend downwardly from the wall 172 and interferingly engage the front wall 173 of the housing 36, as best seen in FIGS. 8 and 8A, to hold the wire guide cap in place. The projections 170 are relatively short so that they can be elastically deflected a slight amount to assemble or disassemble the parts. The cap 40 includes the two openings 18 and 20. The opening 18 is vertically above the area of contact 68 of the first contact member 52 and the opening 20 is vertically above the area of contact of the second contact member 54. The openings 18 and 20 are formed through bosses 200 and 202 on the inside of the wall 172, forming guide surfaces 204 and 206, respectively. These guide surfaces help to guide the conductors 22 and 24 into the area of contact 68 of each contact member. Each of the first wedge-shaped members 136 and 138 includes an extension 164 and 166, respectively, that projects outwardly past the surface 112 and under an edge 168 of the wire guide cap 40. The ends of the extensions 164 and 166 are concave and are in alignment with the surfaces of the openings 18 and 20, respectively, and serve to help guide the conductors 22 and 24 into the area of contact 68 of each respective contact member. The upward movement of the push button 38, due to the action of the third and fourth beams 84 and 86 on the second wedge-shaped members 142 and 144, is limited to the first position 42, shown in FIG. 3, by the extensions 164 and 166 engaging the edge 168 and the projections 130 and 132 engaging the upper walls of the openings 126 and 128. Each of the openings 126 and 128 have an angled surface 129. The two angled surfaces 129 cam the latches 122 and 124 toward the wire guide cap 40 as the push button 38 is moved upwardly into its first position 42 so that the wall 112 is urged into close proximity with the wall 131 of the wire guide cap, for aesthetic purposes. When the push button 36 is depressed from its first position 42 to its second position 46 the first and second beams of both contact members are spread apart sufficiently to permit insertion of the conductors 22 and 24 into their respective openings 18 and 20 so that the conductors enter into and within the area of contact 68 between the first and second beams and will be securely gripped therebetween when the push button is released.

The two contact posts 28 are of rectangular cross section and have smoothly radiused edges. This permits their use with the wire-wrap technology that is used in the present speaker enclosure 10. Each post includes a displaced area 174 that limits its insertion into the connector housing 36. Each contact post is inserted into an undersized opening 176 formed through a boss 178 projecting from the bottom of the housing 36, as best seen in FIG. 8. As the contact posts 28 are inserted into their respective openings 176, the walls of the openings are deformed slightly to conform to the shape and size of the posts, thereby creating an air-tight acoustic seal between the sides of the contact posts and the walls of the openings. The sides of the contact posts also interferingly engage the edges 98 of the openings 96 in the shanks 62 of the first and second contact members 52 and 54, thereby mechanically securing the contact posts to the connector 16 and making good electrical contact between the contact posts and the contact members. In the event that the cable 26 is inadvertently pulled axially in a direction away from the connector 16, the upwardly turned edges 98 will bite into the sides of the contact posts 28 and thereby increase their holding action on the contact posts. Similarly, should the wires 32 be pulled away from the connector 16, the upwardly turned edges 98 will bite into the sides of the contact posts 28 and thereby increase their holding action on the contact posts.

The connector 16 is disposed within an opening 184 formed in the outer housing 12 of the speaker enclosure 10, as shown in FIG. 1. The connector includes a pair of resilient latch members 186 and 188 having oppositely formed extensions 190 and 192 that project mutually outwardly. These extensions catch onto latching shoulders, not shown, that are formed within the speaker enclosure 10, thereby securing the connector within the opening 184. A resilient seal 194 having openings 196 for passage of the contact posts 28 and the latch members 186, is disposed between the connector 16 and a mounting surface, not shown, within the opening 184 for providing an air-tight acoustic seal between the interior of the speaker enclosure and the connector 16. Additionally, the resilient seal 194 is sufficiently resilient to compensate for tolerance accumulation with respect to the latch members 186 and 188.

While the connector 16 is described herein with respect to interconnecting remote acoustical speakers with various audio systems, it will be understood that the connector 16 can be advantageously utilized to electrically attach conductors to other electrical components and equipment, and that such use is considered to be within the spirit and scope of the claims appended hereto. Further, it will be understood that the connector 16 can have more than two contact members 52 and 54 for accommodating more than two conductors 22 and 24. While the contact members 52 and 54 are described herein as being connected to separate contact posts 28, it will be understood that the contact members can have integrally formed tails that are bent downwardly instead of the contact posts 28. Such integrally formed tails can then be easily interconnected to the speaker terminals 30 by means of soldered connections or conventional male/female terminal connections.

Figure 14:
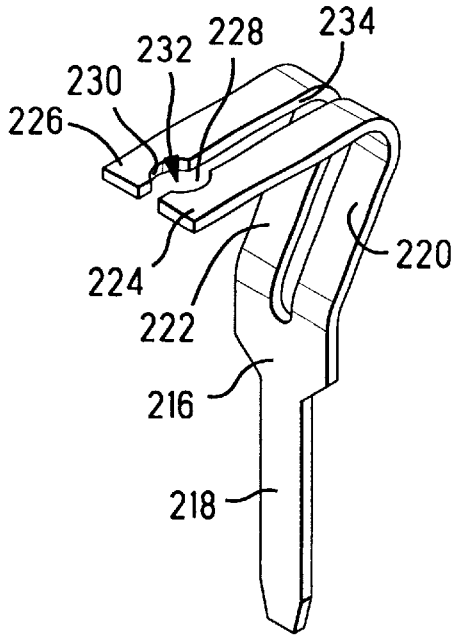
FIG. 14 is an isometric view of a variation of the structure of a portion of the contact member.

A further variation of the contact members 52 and 54 is shown in FIG. 14, including a shank 216, a tail 218 extending downwardly from the shank, and a pair of first and second beams 220 and 222 extending upwardly from the shank. The upper portions 224 and 226 of the first and second beams 220 and 222 are bent horizontally so that they are roughly perpendicular to the shank 216. Opposed openings 228 and 230 are formed in respective upper portions 224 and 226 and define an area of contact 232 for receiving and gripping one of the conductors 22 and 24. First camming surfaces 234 are formed on opposing edges of the first and second beams 220 and 222 and are positioned in alignment with one of the first wedge-shaped members 136 and 138. When the push button 38 is depressed toward its second position 46, the first wedge-shaped member 135 cams against the first camming surfaces 234, thereby causing the first and second beams 220 and 222 to elastically deflect away from each other so that a conductor can be inserted into the area of contact 232. When the push button is released it moves upwardly to its first position 42, the conductor is gripped by the walls of the two opposed openings 228 and 230. While the shank 216 is shown perpendicular to the upper portions 224 and 226, it can be formed parallel thereto and, optionally, can contain the opening 96 for receipt of the contact post 28 instead of having the tail 218. It will be apparent to those skilled in the art that other similar variations of the first and second beams can be utilized in the practice of the present invention.

An important advantage of the present invention is that the first and second beams that cause the conductors to be securely gripped are independent from the third and fourth beams so that once the conductor is inserted and the button released, the third and fourth beams can still urge the button upwardly. Additionally, a single push button functions to open both contacts for simultaneous receipt or removal of both conductors. And the retaining structure for the wire-wrap contact posts provides a good mechanical hold while permitting an air-tight acoustic seal between the connector and the speaker enclosure. Additionally, the single push button structure will concurrently accommodate conductors of different sizes. The present connector can be easily aesthetically integrated into the speaker enclosure for either flush mounting or other desired mounting.

What is claimed is:

1. An electrical connector associated with a component of releasably receiving first and second conductors and electrically interconnecting said conductors to said component comprising:

(1) an insulating housing;

(2) a single insulting button, slidable with respect to said housing between a first position and a second position;

(3) first and second contact members within said housing, each said contact member having a gripping portion for receiving a respective one of said conductors when said button is in said second position and for electrically engaging said respective conductor when said button is in said first position; and a wire guide cap attached to said housing and having two openings, a respective opening in vertical alignment with each respective gripping portion for receiving and guiding said first and second conductors thereinto;

said push button including a projection in sliding engagement with an angled surface on said housing so that when said push button is moved from said second position to said first position said push button is urged toward and into near proximity with said wire guide cap.

2. The connector according to claim 1 wherein each said gripping portion includes an interfering portion that tends to hold said respective conductor in said electrical engagement when said button is in said first position.

3. The connector according to claim 1 wherein each of said first and second contact members includes a shank positioned against a surface of said housing, each said gripping portion comprising a pair of opposed beams extending from opposite edges of a respective said shank upwardly and into pressing engagement with each other at an area of contact spaced from said respective shank.

4. The connector according to claim 1 wherein each said interfering portion is an edge of an opening in one of said opposed beams of said first and second contact members.

5. The connector according to claim 1 wherein said first and second conductors are of different wire gages.

6. An electrical connector associated with a component for releasably receiving first and second conductors and electrically interconnecting said conductors to said component comprising:

(1) an insulating housing;

(2) a single insulating button in sliding engagement with said housing, slidable between a first position and a second position;

(3) first and second contact members in separate cavities within said housing, each contact member having a tail extending therefrom through an opening in said housing and into electrical engagement with said component, a shank positioned against a surface of said housing, and a pair of opposed beams extending upwardly from opposite edges of said shank, wherein a portion of the opposed beams press into engagement with each other at an area of contact to form a gripping portion spaced from said respective shank and wherein a second portion of the opposed beams form a pair of opposed camming surfaces; and (4) resilient means for urging said button into said first position, said resilient including a pair of opposed resilient members having opposed caming ends;

wherein said button includes first and second cams attached thereto for engaging in a first direction said pairs of opposed camming surfaces of respective ones of said first and second contact members in and thereby moving said opposed beams apart at said area of contact for both first and second contact members when said single button is moved to said second position, and wherein said button includes a third cam attached thereto for engaging said opposed camming ends of said resilient members so that when said button is in said second position said opposed resilient members urge said camming ends against said third cam, thereby urging said button into said first position; and wherein the gripping portion receives in the first direction a respective one of said conductors when said button is in said second position and electrically engages said respective conductor when said button is in said first position.

7. The connector according to claim 6 wherein each of said first and second cams is wedge-shaped.

8. The connector according to claim 6 wherein said pair of opposed resilient members extend from said shank.

* * * * *